US012193491B2

(12) United States Patent
Hijma et al.

(10) Patent No.: US 12,193,491 B2
(45) Date of Patent: Jan. 14, 2025

(54) CARTRIDGE FOR AN ELECTRONIC CIGARETTE

(71) Applicant: JT International SA, Geneva (CH)

(72) Inventors: Herman Hijma, Kampen (NL); Paul Voerman, Apeldoorn (NL); Marijn Leneman, Zwolle (NL)

(73) Assignee: JT International S.A. (CH)

( * ) Notice: Subject to any disclaimer, the term of this patent is extended or adjusted under 35 U.S.C. 154(b) by 301 days.

(21) Appl. No.: 17/773,364

(22) PCT Filed: Oct. 30, 2020

(86) PCT No.: PCT/EP2020/080517

§ 371 (c)(1),
(2) Date: Apr. 29, 2022

(87) PCT Pub. No.: WO2021/084072

PCT Pub. Date: May 6, 2021

(65) Prior Publication Data

US 2023/0148664 A1 May 18, 2023

(30) Foreign Application Priority Data

Oct. 31, 2019 (EP) ..... 19206617

(51) Int. Cl.
*A24F 40/42* (2020.01)
*A24F 40/10* (2020.01)
*A24F 40/46* (2020.01)

(52) U.S. Cl.
CPC ..... *A24F 40/42* (2020.01); *A24F 40/10* (2020.01); *A24F 40/46* (2020.01)

(58) Field of Classification Search
None
See application file for complete search history.

(56) References Cited

U.S. PATENT DOCUMENTS

2016/0073694 A1* 3/2016 Liu ..... A24F 40/46 131/329
2017/0112193 A1* 4/2017 Chen ..... A24F 40/46
(Continued)

FOREIGN PATENT DOCUMENTS

CN 107647479 A 2/2018
CN 108883242 A 11/2018
(Continued)

OTHER PUBLICATIONS

International Search Report for Application No. PCT/EP2020/080517 mailed Feb. 8, 2021, pp. 1-4.
(Continued)

*Primary Examiner* — Tho D Ta
(74) *Attorney, Agent, or Firm* — Lerner David LLP

(57) ABSTRACT

A cartridge for an electronic cigarette includes a liquid store arranged to contain a liquid to be vaporized; a vaporization chamber having at least one opening which connects the vaporization chamber to the liquid store; a fluid transfer element held within the opening and extending between the liquid store and vaporization chamber, the fluid transfer element arranged to transfer liquid between the liquid store and vaporization chamber by capillary action; a heating element positioned within the vaporization chamber and arranged to heat a liquid transferred to the vaporization chamber by the fluid transfer element; wherein the cartridge includes an upper housing portion and a lower housing portion which are configured to connect together around the fluid transfer element to form the liquid store, the vaporization chamber and the at least one opening. This provides an improved seal around the fluid transfer element to minimize leakage into the vaporization chamber.

20 Claims, 6 Drawing Sheets

(56) References Cited

U.S. PATENT DOCUMENTS

| | | | | |
|---|---|---|---|---|
| 2017/0164655 | A1* | 6/2017 | Chen | A24F 40/46 |
| 2018/0020730 | A1 | 1/2018 | Alarcon et al. | |
| 2018/0153218 | A1* | 6/2018 | Verleur | H05B 3/44 |
| 2019/0022345 | A1* | 1/2019 | Kotch | A61M 16/145 |
| 2019/0046745 | A1 | 2/2019 | Nettenstrom et al. | |
| 2019/0099561 | A1* | 4/2019 | Nettenstrom | A24F 40/40 |

FOREIGN PATENT DOCUMENTS

| | | | |
|---|---|---|---|
| EP | 3015010 | A1 | 5/2016 |
| EP | 3275323 | A2 | 1/2018 |
| GB | 2548647 | A | 9/2017 |
| WO | WO-2016122417 | A1 * | 8/2016 |

OTHER PUBLICATIONS

Search Report from the Office Action for Chinese Application No. 202080076503.0 issued Jul. 30, 2024, 2 pages.

* cited by examiner

CARTRIDGE FOR AN ELECTRONIC CIGARETTE

CROSS-REFERENCE TO RELATED APPLICATIONS

The present application is a national phase entry under 35 U.S.C. § 371 of International Application No. PCT/EP2020/080517, filed Oct. 30, 2020, published in English, which claims priority to European Application No. 19206617.3 filed Oct. 31, 2019, the disclosures of which are incorporated herein by reference.

TECHNICAL FIELD

The present invention relates to a cartridge for an electronic cigarette.

BACKGROUND

Electronic cigarettes are an alternative to conventional cigarettes. Instead of generating a combustion smoke, they vaporize a liquid, which can be inhaled by a user. The liquid typically comprises an aerosol-forming substance, such as glycerin or propylene glycol that creates the vapor. Other common substances in the liquid are nicotine and various flavorings.

The electronic cigarette is a hand-held inhaler system, comprising a mouthpiece section, a liquid store and a power supply unit. Vaporization is achieved by a vaporizer or heater unit which typically comprises a heating element in the form of a heating coil and a fluid transfer element, such as a wick, arranged to transfer fluid from the liquid store to the heating element. Vaporization occurs when the heater heats up the liquid in the fluid transfer element until the liquid is transformed into vapor. The vapor can then be inhaled via an air outlet in the mouthpiece.

The electronic cigarette may comprise a cartridge seating which is configured to receive disposable consumables in the form of cartridges. Cartridges comprising the liquid store and the vaporizer are often referred to as "cartomizers". In this case, the vaporizer of the cartomizer is connected to the power supply unit when received in the cartridge seating such that electricity can be supplied to the heater of the cartomizer to heat the liquid to generate the vapor. Often some form of mechanical mechanism is used to retain the cartridge in the cartridge seating such that it does not fall out and separate from the device.

In order to transfer liquid from the liquid store to the heating element, the wick must be arranged between the liquid store and vaporization chamber such that, when the wick is heated, capillary action transports liquid through the porous structure of the wick from the liquid store to the hating element. A common problem with electronic cigarettes is leakage of liquid from the liquid store to the vaporization chamber, other than through the wick as intended. This results in liquid pooling in the vaporization chamber which can be transported in the air flow route to the mouthpiece, leading to large liquid droplets in the inhaled vapor which is unpleasant to a user. Similarly the liquid collecting in the vaporization chamber can come into contact with the electrical contacts of the heating element and it can leak through the air inlets in the cartridge seating itself, possibly causing degradation of the battery contacts and coating the electronic cigarette and cartridge making it unpleasant to handle.

It is an object of the present invention to provide an electronic cigarette which makes progress in solving some of the problems of prior art devices identified above.

SUMMARY OF THE INVENTION

In a first aspect of the invention there is provided a liquid store arranged to contain a liquid to be vaporized; a vaporization chamber having at least one opening which connects the vaporization chamber to the liquid store; a fluid transfer element held within the opening and extending between the liquid store and vaporization chamber, the fluid transfer element arranged to transfer liquid between the liquid store and vaporization chamber by capillary action; a heating element positioned within the vaporization chamber and arranged to heat a liquid transferred to the vaporization chamber by the fluid transfer element; wherein the cartridge comprises an upper housing portion and a lower housing portion which are configured to connect together around the fluid transport element to form the liquid store, the vaporization chamber and the at least one opening.

The upper housing portion and lower housing portion together preferably provide an outer housing of the cartridge.

As the cartridge housing comprises two parts which fit together to provide the opening holding the fluid transport element, a precisely dimensioned and positioned opening can be provided which is configured to closely fit around the fluid transport element to reduce leakage through the opening around the fluid transfer element. Furthermore the assembly process is simplified as the fluid transport element does not need to be fed through the opening but is simply enclosed within it as the two housing parts are connected together. By forming the liquid store, vaporization chamber and the connecting opening in this way the number of parts required is also reduced, which further simplifies the assembly process and reduces the manufacturing cost. Because the cartridge housing closes around the fluid transport element to form the openings, the position of the fluid transport element can be precisely configured and therefore the performance of the cartridge is improved over known devices in which the fluid transport element is first positioned within a vaporizer which is then positioned within a device, which can results in the numerous components not being correctly positioned, leading to leakage within the cartridge. This arrangement also allows for the liquid transport element to be held securely in place during assembly of the device, in particular for connection of the heating wire to the cartridge contact plates.

Preferably the fluid transport element is a capillary structure, for example a capillary wick preferably comprising a porous and/or fibrous structure.

The housing portions preferably provide the outer housing of the cartridge and preferably include one or more internal walls of divisions which, when connected together, define the liquid store, the vaporization chamber and the at least one opening. In some example of the invention the upper housing portion comprises the upper and side walls of the liquid chamber and the upper and side walls of the vaporization chamber and the lower housing portion comprises the base surface of the liquid store and the base surface of the vaporization chamber.

The vaporization chamber may be positioned substantially within the liquid store such that the liquid store at least partially surrounds the vaporization chamber.

Preferably the vaporization chamber comprises two openings which connect the vaporization chamber to the liquid store and the fluid transfer element is elongate; wherein the elongate fluid transfer element extends across the vaporization chamber with two opposing ends held within the openings and interfacing with the liquid store. In this way, liquid from the liquid store is more efficiently transported to the vaporization chamber through the capillary action of the liquid transport element.

Preferably, the upper housing comprises a curved upper supporting surface and the lower housing portion comprises an opposing curved lower supporting surface; wherein the upper and lower supporting surfaces together form the at least one opening holding the fluid transfer element when the upper and lower housing portions are connected together. In this way the curved surfaces meet the fluid transport element and may press into the sides of the fluid transport element to reduces leakage. Preferably the curved shape of the supporting surfaces fits the cross-sectional shape of the fluid transport element to provide a tight connection between the fluid transport element and supporting surfaces.

Preferably the upper supporting surface and lower supporting surfaces are semi-circular such that the at least one opening is circular when the upper and lower housing portions are connected together. Preferably the fluid transport element has a substantially circular cross section to match the opening. Preferably the diameter of the opening is less than the diameter of the wick.

In preferable examples of the invention the cartridge further includes an annular seal mounted in each of the one or more openings which connect the vaporization chamber to the liquid store; the annular seal engaged around the fluid transfer element such that liquid is restricted in passing through the opening other than through the liquid transfer element. In this way, the sealing around the fluid transport element is further enhanced to reduce leakage around the liquid transport element. Because the cartridge comprises two housing parts which are connected together to form the openings, the annular seals can be precisely positioned to optimize the sealing.

In some examples the annular seal comprises an upper seal segment attached to the upper housing portion and a lower seal segment attached to the lower housing portion; wherein the upper and lower seal segments together form the annular seal around the fluid transfer element when the upper and lower housing portions are connected. In this way, the annular seal is formed as the housing parts are connected. This removes the need to sleeve the annular seal on the wick prior during assembly and position the annular seal within the seating, which simplifies the assembly process.

In other example the cartridge comprises a curved upper supporting surface and the lower housing portion comprises an opposing curved lower supporting surface; wherein the corresponding upper and lower supporting surfaces provide a seating configured to receive the annular seal. Preferably the annular seal is an integral annular seal formed in a single part and is preferably sleeved on the fluid transfer element, prior to mounting in the cartridge. In this way a tighter connection around the fluid transfer element is provided which reduces the risk of parts of the fluid transfer element, such as loose fibers, coming away from the fluid transfer element and breaking the seal.

Preferably the upper and lower supporting surfaces are shaped to form a circumferential groove when the upper and lower housing portions are connected, wherein the circumferential groove is configured to receive the annular seal. A circumferential groove provides a reliable mount for the annular wick to hold it in place. Preferably the circumferential grooves comprises two circumferential surfaces forming a V-shaped cross-section and the annular seal comprises a rounded profile which meets both of the surfaces to provide two circumferential contacts between the annular seal and its seating. In this way, the annular seal meets the seating at two points along the axis of the annular seal which provides two sealing points to stop the passage of fluid around the fluid transfer element, through the opening, thus enhancing the sealing properties.

Preferably the annular seal comprises a substantially cylindrical body with a rounded circumferential protrusion extending radially outward to meet the surfaces bounding the openings. Preferably the length of the cylindrical body is greater than the length through the opening. This can aid in keeping loose fibers from the fluid transfer element getting between the contacting surfaces of the two housing parts when they are joined, The radially extending outward protrusion creates a tight seal against the seal seating of the opening.

The annular seal preferably comprises a substantially cylindrical body with an internal circumferential protrusion extending radially inward to press into the liquid transfer element within the seal. In this way, a tight seal between the annular seal and fluid transfer element is provided to minimize leakage through the annular seal. The distance of extension of the protrusion into the fluid transfer element also restricts fluid transport through the wick by compressing the capillary structure. The distance of radial extension of this protrusion can be configured to adapt the force pressing into the wick such that the balance between sealing around the wick and the restriction of fluid transfer through the wick can be tailored appropriately. Preferably the width of the inner protrusion is less than the width of the outer protrusion.

Preferably the seal comprises an elastic deformable material, for example silicone. In this way the seal deforms around the shape of the supporting surfaces and/or the fluid transfer element to further limit leakage.

Preferably the contacting surfaces of the upper housing portion and the lower housing portion when connected define a plane which runs lengthwise through the liquid transport element. In particular the plane of connection between the upper and lower housing portions runs through the liquid transport element. Otherwise stated, the upper and lower housing portion comprise surfaces of the outer housing which meet when the upper and lower housing portions are connected, the plane defined by these surfaces when connected runs through the liquid transport element, preferably through the center of the liquid transport element, preferably along the elongate axis. This improves the ease of assembly of the housing parts around the fluid transport element.

Preferably, the lower housing portion comprises air inlets to allow air into the vaporization chamber; wherein the air inlets are provided on a raised portion of a lower internal surface of the vaporization chamber. In this way, even if liquid were to leak into the vaporization chamber, because the air inlets are provided on raised surfaces above the inner base surface of the vaporization chamber, liquid will collect on the base surface but will not leak through the air inlets into the device. Furthermore, it will not enter the air stream such that large un-vaporized liquid droplets in the inhaled vapor are reduced. In some examples, a liquid absorbing material is provided on the lower internal surface of the vaporization chamber around the raised portions in order to collect and store any liquid collecting in this region to prevent it reaching the air inlets if the orientation of the device is changed.

In a further aspect of the invention there is provided an electronic cigarette comprising the cartridge as defined in any of the claims and a power source arranged to provide power to the heating element.

DETAILED DESCRIPTION

Figure 1A:
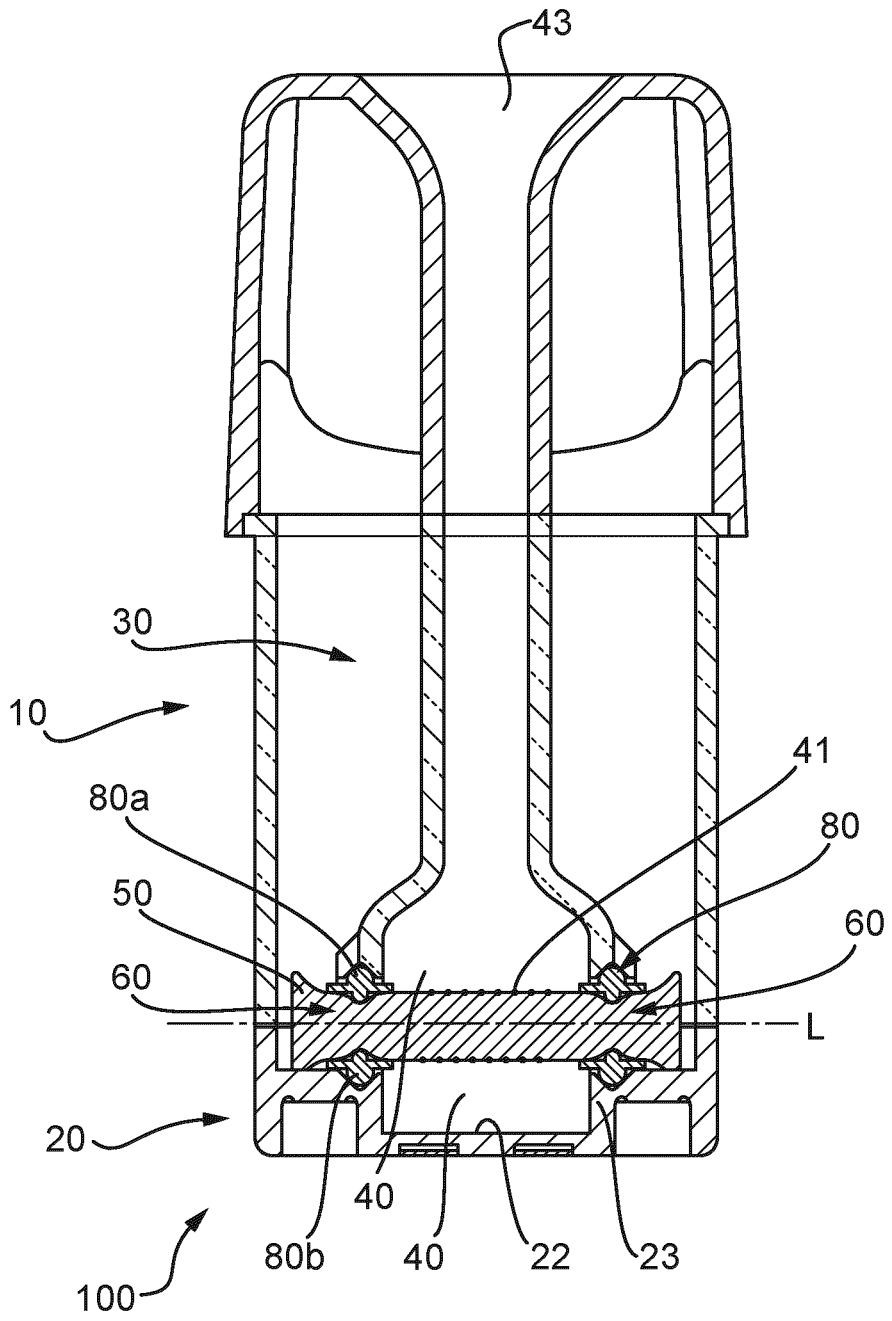
FIGS. 1A and 1B show a cartridge for an electronic cigarette according to the present invention.
Figure 1B:
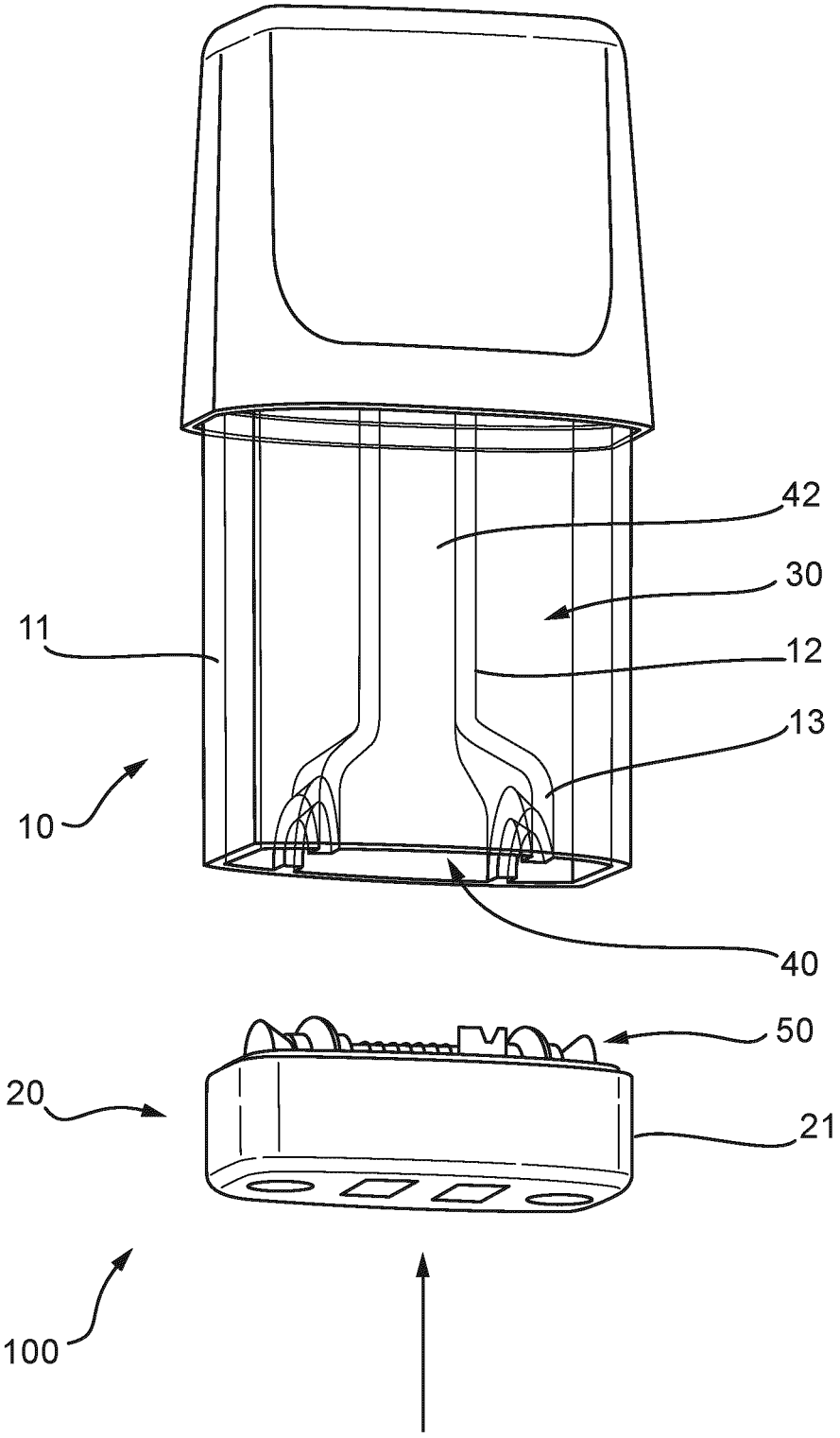

FIGS. 1A and 1B schematically illustrate a cartridge 100 for an electronic cigarette according to the present invention. The cartridge 100 includes a liquid store 30 arranged to contain a liquid to be vaporized and a vaporization chamber 40, where the vaporization chamber 40 has at least one opening 60 which connects the vaporization chamber 40 to the liquid store 30. A fluid transport element 50 extends between the liquid store 30 and the vaporization chamber 40 and is supported within the opening 60. The fluid transfer element 50 is arranged to transfer liquid between the liquid store 30 and the vaporization chamber 40 by capillary action. A heating element 41 is positioned within the vaporization chamber 40 and is arranged to heat the liquid that is transferred by capillary action to the vaporization chamber 40 by the fluid transfer element 50. As most clearly shown in FIG. 1B the cartridge comprises an upper housing portion 10 and a lower housing portion 20 which are configured to connect together around the fluid transfer element 50 to form the liquid store 30, the vaporization chamber 40 and the at least one opening 60 connecting the vaporization chamber 40 and the liquid store 30.

The cartridge according to the present invention improves that use of assembly and allows for a fluid transfer element 40 or "wick" 40 to be positioned so as to be tightly fitted within the opening 60 connecting the vaporization chamber 40 and liquid store 30, thereby reducing leakage from the liquid store through the opening 60 into the vaporization chamber 40. This "tight fit" of the fluid transfer element reduces the amount of liquid that normally tends to travel along the surface of a fluid transfer element. The present arrangement therefore forces the liquid transportation through the interior of the fluid transfer element by capillary action, which leads to a more controlled flow. Moreover, the flow of liquid through the fluid transfer element essentially only takes place during vaporization as liquid is drawn by capillary action in order to compensate for the liquid being vaporized in the contact area with the heating element. This improves the user experience by reducing the amount of large liquid droplets entering the vaporization chamber 40 and accordingly being inhaled by a user rather than solely be vapor generated by the heater 41.

Because the cartridge is formed of two housing components 10, 20 which fit around the fluid transfer element to define the openings and the vaporization chamber 40 and liquid store 30 when connected together, the fluid transfer element 50 may be positioned in a straightforward manner with the housing components closed around it, rather than requiring the fluid transfer element to in some way be threaded into an opening within the housing. The present invention therefore allows for the wick 50 to be tightly fitted in an improved cartridge in which the ease of manufacture is enhanced.

In the example of the present invention shown in the figures the fluid transfer element 50 is in the form of a capillary wick 50 which may be formed for example by a bundle of fibers such as cotton fibers or another porous structure which is configured to transport liquid from the liquid store 30 through to the vaporization chamber 40 via capillary action through the porous wick structure, driven by the evaporation of liquid from the center of the wick by the heating element 41. The fluid transport element 50 preferably comprises an elastic or compressible material such that it is compressible in a radial direction. In this way, the upper and lower housing portions 10, 20 compress the wick at the engagement points to restrict passage of the liquid through the openings, as will be described. The two housing portions 10, 20 together form a central vaporization chamber 40 and surrounding liquid store 30. In particular, as shown in FIG. 1B the upper housing portion 10 includes an outer wall 11 forming the outer boundary of the liquid store 30 and a number of internal walls 12, 13. In particular the upper housing portion 10 includes a tubular central wall 12 which defines a tubular air flow passage aligned along the elongate axis of the cartridge which leads from the vaporization chamber 40 to an inhalation outlet 43 at a mouth end of the cartridge 100. The internal side wall 12 forming the inhalation passage 42 within the surrounding liquid store 30 extends radially outwards around the wick 50 and heater 41 to form the outer bounds of the vaporization chamber 40 around the fluid transfer element 50. As shown in FIG. 1B the internal walls 12 forming the air flow passage to the mouthpiece are connected to the walls 13 of the vaporization chamber 40. The internal vaporization chamber walls 13 form part of the side walls and upper walls which define the upper portion of the vaporization chamber 40 when the cartridge 100 is assembled.

Figure 2A:
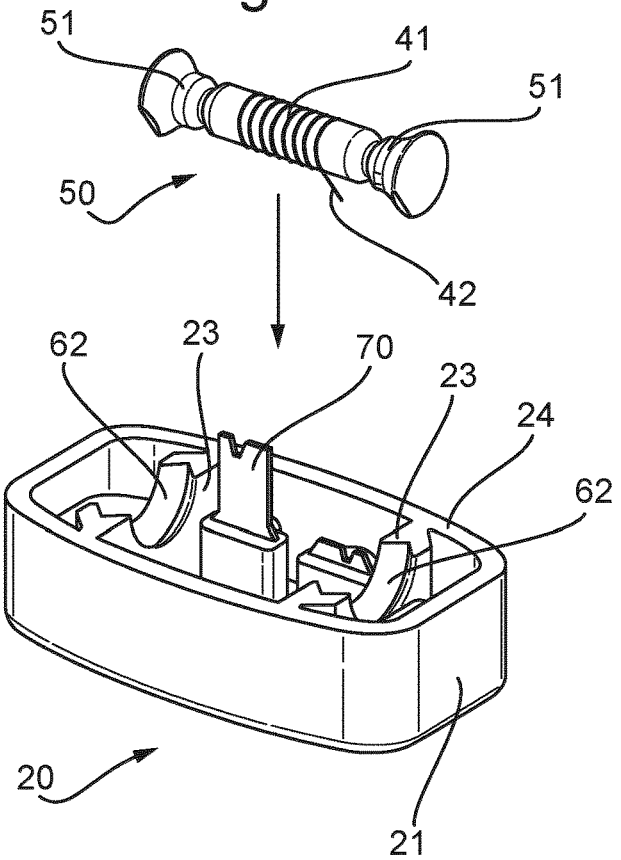
FIGS. 2A and 2B show a cartridge for an electronic cigarette according to the present invention which does not use an annular seal.

The lower housing portion 20 comprises an outer housing wall 21 defining the outer bounds of the housing portion 20. As most clearly shown in FIG. 2A the lower housing portion 20 also has a number of internal walls 23 which, together with the internal walls 13 of the upper housing portion 10, form the internal walls defining the volume of the vaporization chamber 40. In particular, the lower housing portion has an internal lower base wall 22, shown in FIG. 1A, and two internal side walls 23, as shown in FIG. 2A. As shown in FIG. 1A, the internal walls 13, 23 of the upper housing portion 10 and lower housing portion 20 fit together when the upper and lower housing portions 10, 20 are connected to define the outer bounds of the vaporization chamber 40, within the internal volume of the cartridge 100 defined by outer side walls 11 and 21 of the upper and lower housing portions. In this way, the internal vaporization chamber 40 is partially surrounded by the liquid store 30. In particular, the internal walls are shaped so as to provide a vaporization chamber 40 centrally within the internal volume of the cartridge, with the volume of the liquid store defined at least partially around it extending down on at least two opposing sides of the vaporization chamber 40.

This structure differs to known devices in that two integral housing portions, the upper and lower housing portions 10, 20, together form the outer housing of the cartridge and each of the vaporization chamber 40, liquid store 30 and the connecting openings 60. Known devices often require the insertion of separate components within the outer housing to provide the vaporization chamber and therefore require much more complex assembly and alignment of components which, when not precisely achieved, can lead to leakage.

Figure 2B:
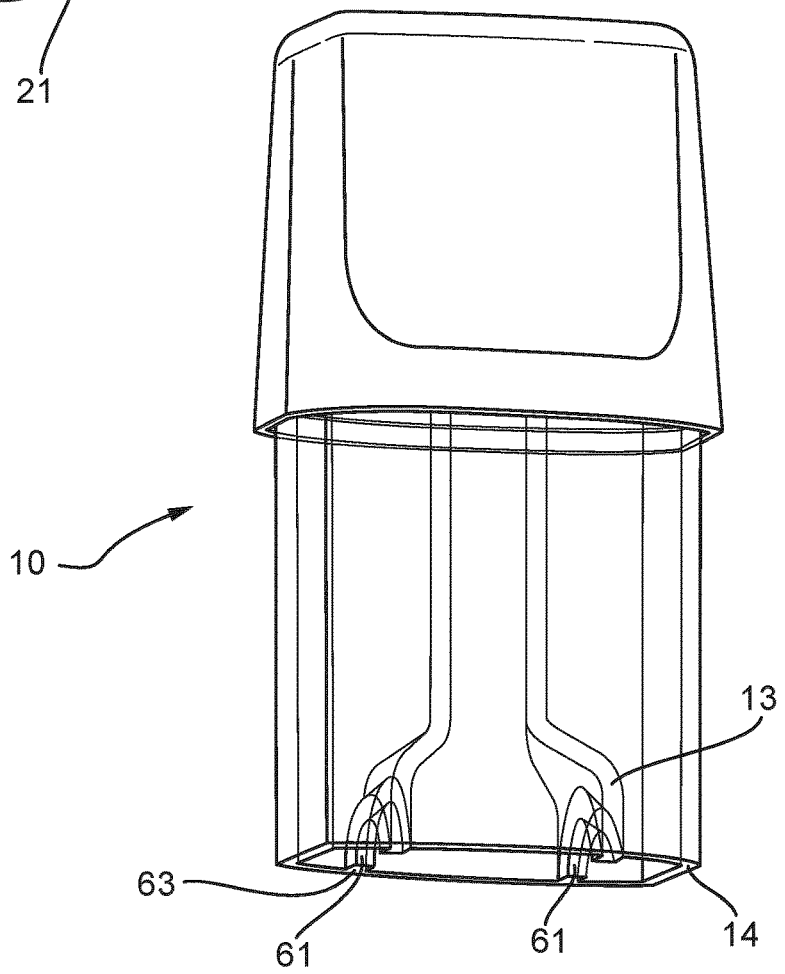

As shown in FIGS. 2A and 2B, the internal side walls 13, 23 provided by the upper 10 and lower 20 housing portions which define the vaporization chamber 40 each comprise curved surfaces 61, 62 which together also form the opening 60 which connects the liquid store and heating chamber 40 when the housing portions are connecting together. In this way, the vaporization chamber 40 is provided centrally within the internal volume of the cartridge 100 with, in the example of the figures, two openings 60 within the side walls of the vaporization chamber, which place the vaporization chamber in fluid communication with the surrounding liquid store 30. As shown in FIG. 2A, the surfaces 62 which define the opening 60, support the ends 51 of the capillary wick 50, such that when the housing portions 10, 20 are brought together the ends 51 of the capillary wick are tightly received within the opening 60 formed by the surfaces 61, 62 as shown in FIGS. 1A and 1B.

In the example of the figures, the fluid transfer element 50 is an elongate capillary wick as shown in FIG. 2A which extends across the internal volume of the heating chamber 40 with its opposing ends 51 received in the openings 60 within the internal side walls of the vaporization chamber 40. In this way, when the housing portions are brought together as shown in FIG. 1B and the internal volume of the liquid store 30 is filled with liquid, the capillary wick fills the openings 60 such that the ends 51 of the wick are in communication with the liquid within the internal volume of the liquid store 30 and liquid is drawn into the vaporization chamber 40 through the capillary wick 50 during heating. Since the openings 60 are formed by the opposing surfaces 61, 62 of two separate housing parts 10, 20 the construction of the cartridge 100 is simplified and a tighter connection of the opening 60 around the wick 50 can be achieved.

A known problem in such devices is constricting the wick with sufficient pressure within the opening 60 connecting the liquid store 30 and vaporization chamber 40 so as to not allow liquid to leak around the wick into the vaporization chamber, whilst not applying excessive pressure such that transport of liquid through the interstices formed by the fibers of the wick 50 such that fluid transport through the wick 50 is restricted. By providing the opening 60 in the form of two constituent parts which are fitted together around the wick 50 the diameter of the opening 60 can be precisely engineered to provide the required tight fit whilst still allowing sufficient liquid flow through the capillary wick 50. Furthermore, the shape of the upper and lower 61, 62 supporting surfaces which form the opening 60 holding the wick 50 can be provided with specific shapes or surface features to securely hold the wick with the correct pressure. In the example of the figures, the supporting surfaces are semi-circular in shape to together form a substantially circular opening 60. The surfaces may be formed for example with a circumferential protrusion which presses into the capillary wick 50 to restrict liquid flow around the wick 60.

As shown most clearly in FIG. 2A, the heating element is a heating coil 41 which is coiled around the wick and has two ends 42 which extend out from the wick to contact electrical contact plates 70. By providing power to the electrical contact plates 70 and subsequently to the heating element the current can be provided through the heating element to heat the electrical coil and vaporize a liquid transported from the liquid store 30 through the liquid transport element 50 within the vaporization chamber 40.

In the example of FIGS. 2A and 2B the capillary wick 50 is simply received within the opening 60 formed by the supporting surfaces 61, 62 of the upper 10 and lower 20 housing portions. Preferably, the sealing of the opening around the capillary wick 50 is further enhanced by the use of annular seals 80 which are mounted in each opening 60 wherein the annular seals 80 are engaged around the fluid transfer element 50 such that liquid is restricted in passing through the opening 60 other than through the liquid transfer element 50, as shown in FIG. 1A. The annular seals 80 are preferably made of a deformable elastic material and bound the parameters of the opening 60 such that the capillary wick 50 passes through the annular seals 80 within each opening 60 to interface with the liquid store 30. The annular seals 80 provide a tight engagement with the supporting surfaces 61, 62 to substantially restrict the passage of liquid around the wick 50 through the opening 60 into the vaporization chamber 40.

The annular seals 80 may be provided in a number of different ways. In one example, the annular seals 80 may comprise two components, an upper seal segment 80*a* which is attached to the upper supporting surface 61 of the upper housing portion 10 and a lower seal segment 80*b* which is attached to the lower supporting surfaces 62 of the lower housing portion 20. In particular, the annular seals 80 may be formed by the curved supporting surfaces 61, 62 themselves being formed of an elastic deformable material such that when the housing portions 10, 20 are connected together around the wick 50 the seal segments 80*a*, 80*b* form a complete annular seal 80 around the wick 50 to seal the openings 60. For example, looking at FIG. 1A the annular seal 80 may be formed by upper seal segment 80A and lower segment 80B, attached to the lower housing portion 20, such that when the housing portions 10, 20 are brought together they form a complete annulus around the capillary wick 50.

Figure 3A:
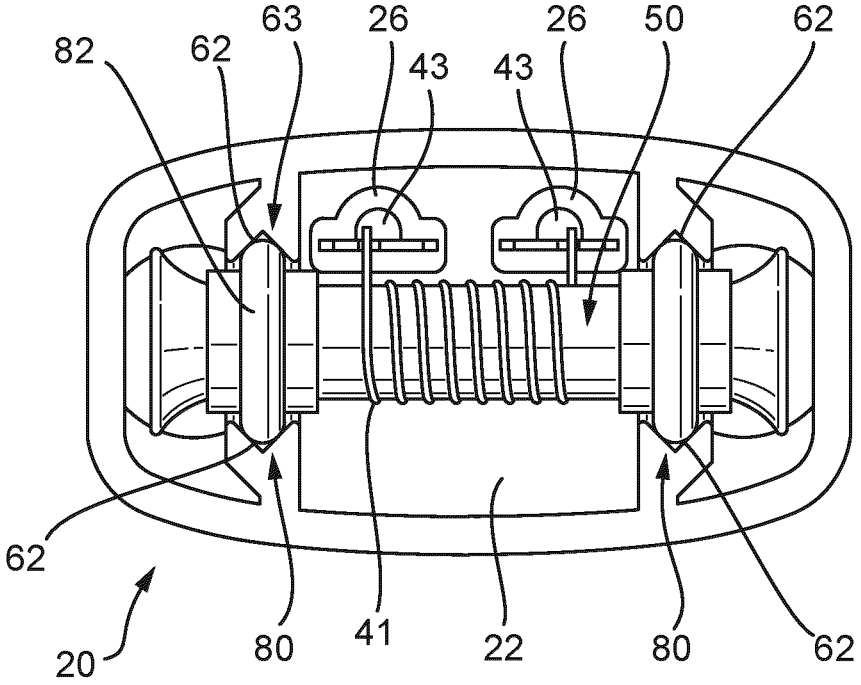
FIGS. 3A to 3C illustrate details of a cartridge for an electronic cigarette according to the present invention.
Figure 3B:
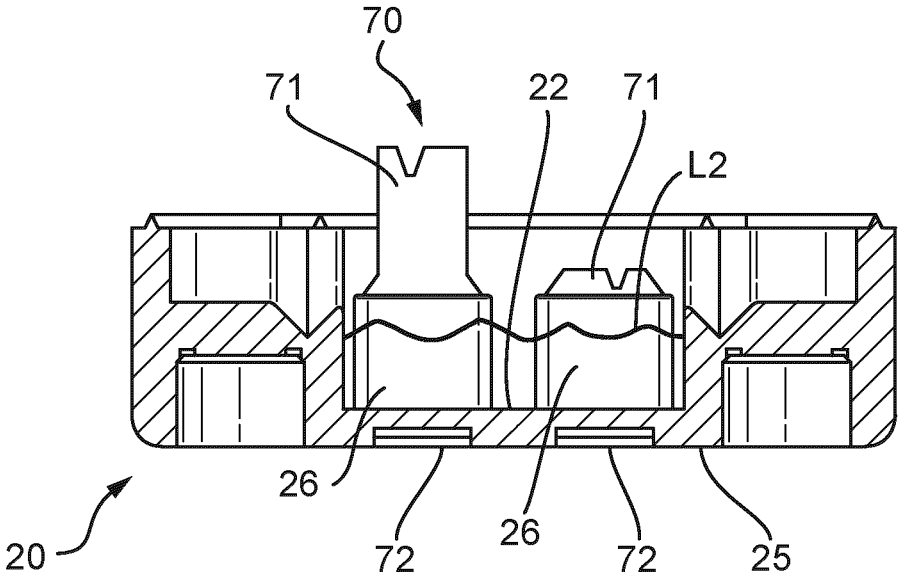

Alternatively, the upper supporting surface 61 in the upper housing portion 10 and the lower supporting surface 62 in the lower housing portion 20 may provide a seal seating configured to receive an integral annular seal 80, as shown in FIG. 3A in a plan view of the liquid transfer element 50 received in the lower housing portion 20. As shown in FIG. 3A, the lower supporting surfaces are shaped to form a groove 63 which is configured to receive the annular seal 80. A corresponding groove is provided by the upper supporting surfaces 61 as shown in FIGS. 3B and 2B. In this way, the upper and lower supporting surfaces 61, 62 form a seating which retains an integral annular seal 80 in place within the opening 60. A cross section of such an annular seal 80 when received in the seating provided by the groove 63 is shown in FIG. 3B. As shown in FIG. 3B the circumferential groove 63 comprises two circumferential surfaces which form a V shaped cross section.

In particular, the upper supporting surface 61 comprises angled circumferential surfaces 61*a* and 61*b* which together form a V-shaped cross section of the circumferential groove 63. Similarly, the lower supporting surfaces provided by the lower housing portion comprise angled supporting surfaces 62*a*, 62*b* which together form a V-shaped cross section such that, when the upper 10 and lower 20 housing portions are connected together a complete circumferential V-shaped groove is provided around the opening 60, as shown in FIG. 3B. This V-shaped groove acts to hold the annular seal 80 in place forming a tight connection to prevent it being dislodged and to provide a tight seal to prevent the passage of liquid. The annular seal 80 itself may be configured with a number of additional features to further enhance the sealing properties are provided by the annular seal 80 within the opening 60.

As shown in FIG. 3B, the annular seal 80 comprises a substantially tubular body 81 formed in this example of a cylindrical main body 81. The seal 80 also includes a rounded circumferential protrusion 82 extending radially outward around the circumference of the annular seal 80, as clearly shown in FIG. 3A. The rounded profile of this protrusion 82 meets the two surfaces forming the V-shaped groove 63 to provide enhanced sealing properties. In particular because the rounded profile of the protrusion 82 meets the two angled surfaces 61*a*, 61*b* of the upper housing 10 and the angled surfaces 62*a*, 62*b* of the lower housing 20, the annular seal provides two sealing points along the tubular axis of the annular seal 80. In particular, the contact points on each of these angled surfaces provide a complete circumferential contact line such that the seating provided by the supporting surfaces and the annular seals together provide two circumferential contact lines around the opening 60 which significantly restrict the passage of liquid around the annular seal 80 into the vaporization chamber 40. The annular seal 80 of this example also includes an internal circumferential protrusion extending radially inward from the cylindrical body 81 to press into the capillary wick 50. By configuring the length of radial extension of this internal circumferential protrusion 83, the tightness of the grip on the wick 50 can be configured to optimize the seal 80 to prevent the passage of liquid between the wick 50 and the annular seal 80 whilst allowing the capillary transport of liquid through the wick 50.

As described above the seal preferably comprises an elastic deformable material which deforms under the contact force against the angled surfaces forming the seating 63 and so conforms to the surfaces of the seating and the wick 50 to provide a tight seal. Silicone provides a particularly preferably material which can be adapted to provide the right degree of elasticity and can be produced in a straightforward manner by moulding.

As shown in FIGS. 2A and 2B the upper housing portion and lower housing portion 20 contact each other around the perimeter of the cross section of the outer walls 11, 21 at corresponding contacting surfaces 14, 24. In particular, the upper and lower housing portions 10, 20 are brought together in the direction of the arrow in FIG. 1B such that the upward facing contact surface 24 of the outer wall 21 of the lower housing portion comes into contact with the opposing downward facing contact surface 14 of the outer wall 11 of the upper housing portion 10. These contacting surfaces may be attached by a number of different manufacturing techniques such as via an adhesive or ultrasonic welding. Preferably this plane of connection defined by the opposing contacting attachment surfaces 24, 14 defines a plane of connection L shown in FIG. 1A which runs centrally through the elongate axis of the capillary wick 60. This aids in manufacture and allows the wick to be placed on the supporting surfaces and the opposing attachment surfaces bonded together to attach the housing portions 10, 20.

As described above the coiled heating wire 41, coiled around the wick, is contacted to the contacting plates 70, as most clearly shown in FIG. 3A. In particular, there are two contacting plates 70 which extend upwards from the base surface 22 of the vaporization chamber 40 provided by the lower housing portion 20. Each contacting plate 70 is preferably formed by an upwardly extending portion 71 which extends upwards approximately perpendicular to the base surface 22 of vaporization chamber 40 and a folded perpendicular portion 72 which lies flat along an outer surface at the base of the lower housing portion 20. The contacting plates 70 are folded to form a perpendicular arrangement with the top wire-contacting portion 71 extending through an opening in the lower housing portion 20 and folded to form the second base contact portion 72 lying flush along the base surface 25 of the lower housing portion 20. In this way when the cartridge 100 is received in an aerosol generating device the base contact portion 72 of the contacting plates 70 may contact corresponding contacts which are connected to the battery to provide current through the contact plate 70 to the heating wire 41.

Figure 3C:
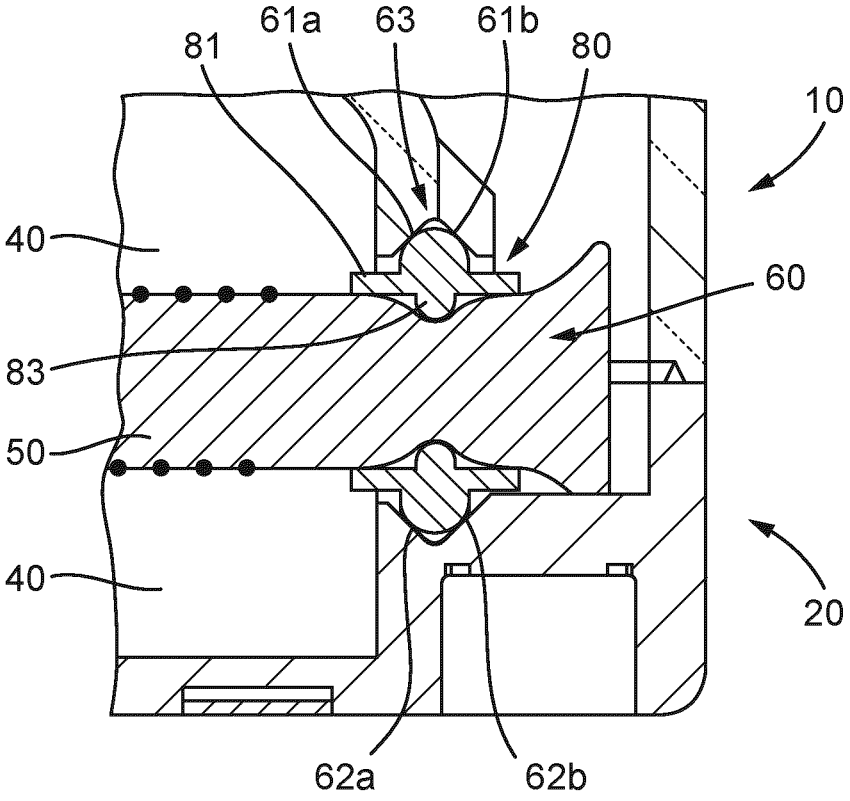

As shown in FIG. 3C the top portion 71 of the contact plate 70 extends through raised portions 26 of the lower internal surface 22 of the vaporization chamber 40. In particular, the base surface is formed by the lower internal surface 22 of the lower house portion and this has two protruding platforms 26 which extend upwardly from the base surface 22 and the wire engaging portion 71 of the contacting plates emerge from holes within these raised platforms 26 as shown in FIG. 3A.

By providing the contact plates 70 within raised platform portions 26 of the base of the vaporization chamber 22, even if a small amount of liquid leaks passed the improved seal provided by the present invention, then this liquid will collect around the raised platforms 26 as shown in FIG. 3C, and not be in contact with the electrical terminals 70. The air inlets to the vaporization chamber 43, shown in FIG. 3A are also provided through these raised platforms 26 such that, again, a liquid which leaks through pass the seals 80 is collected in the bottom of the vaporization chamber 40 and so droplets from any leaked liquid cannot get into the vapor flow stream through the air inlet 43 as these are provided below the inlets 43 at the base of the vaporization chamber. In this way, the improved sealing provided by the opening 60 around the wick 50, together with the raised platforms 26 means that the amount of liquid droplets reaching the air flow through the mouth piece is significantly reduced.

Although in the illustrated embodiments the contact plates 70 are provided on the same side of the wick providing the fluid transport element 50 (i.e. both contact plates 70 are positioned adjacent to the same longitudinal side of the fluid transport element 50), in other embodiments the contact plates 70 may be positioned on opposite sides of the fluid transport element 50. By positioning the contact plates 70 on opposite sides of the fluid transport element 50 (i.e. arranging the contact plates 70 such that the fluid transport element 50 runs between the contact plates), the contact plates may provide additional thermal insulation to the heating wire 41 and wick, thereby enhancing the efficiency of the device.

Figure 4:
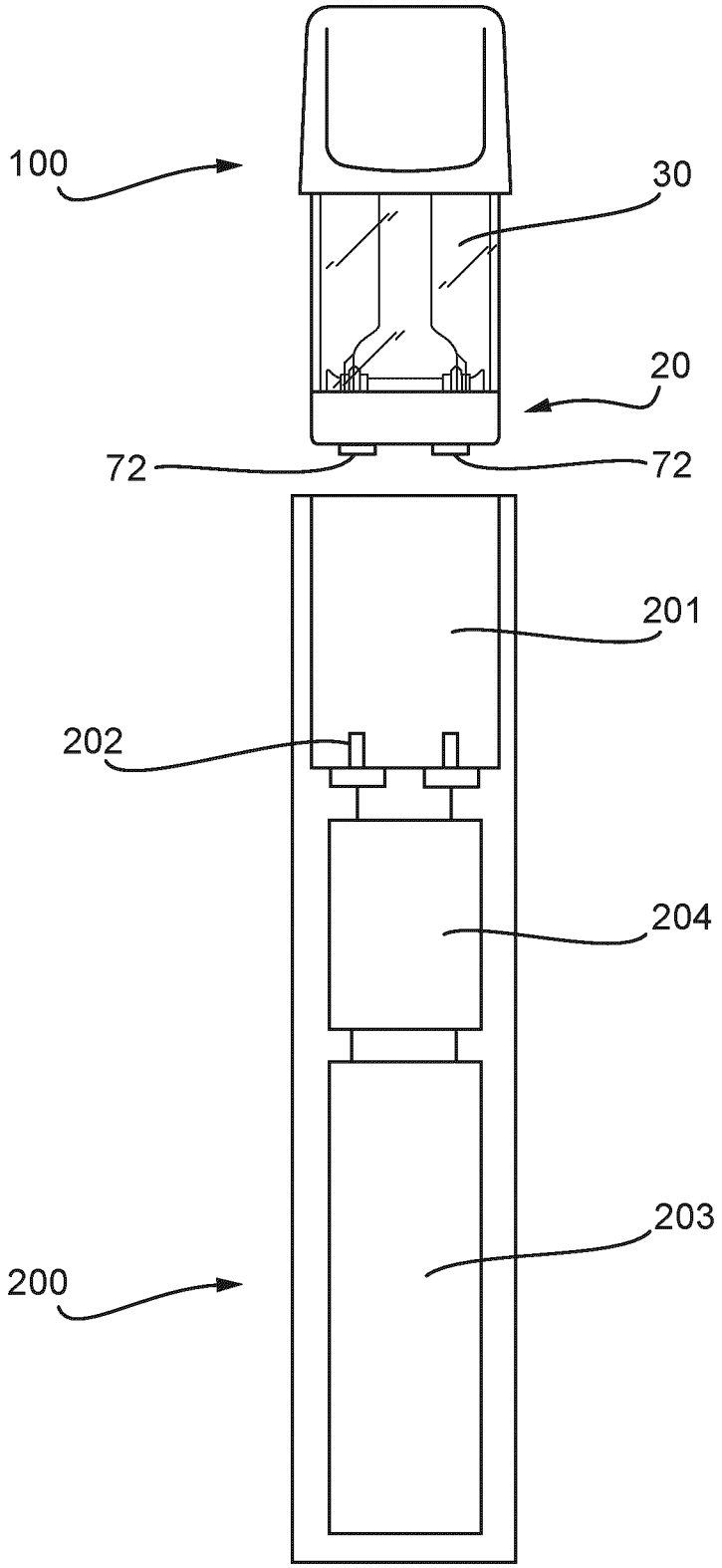
FIG. 4 illustrates an aerosol generating device configured to receive a cartridge according to the present invention.

As shown in FIG. 4 the cartridge 100 is configured to be received in the cartridge seating 201 of an aerosol generating device 200. The contacts 72 on the outer base surface 25 of the lower housing portion 20 contact corresponding contacts 202 positioned at the base surface of the cartridge seating 201. These contacts 202 may be spring biased such that they retract under contact back into recesses within the base of the cartridge seating 201. The bias ensures that there is a sufficient contact between the contact 202 of the aerosol generating device and those 72 of the cartridge 100. When the cartridge is received in the cartridge seating 201 current provided by a battery 203 may be provided to the contacts 72 and to the heating element 41 to vaporize liquid transported from the liquid chamber 30 to the vaporization chamber via the liquid transport element 50. Wherein the provision of the current can be controlled by control circuitry 204 to control the amount of current applied to the heating element 41.

With the cartridge 100 according to the present invention an increased resistance to leakage into the vaporization chamber is achieved, whilst providing a simplified manufacturing process. In particular, by providing a two part cartridge with an upper and lower housing portion 10, 20 which can be connected around the fluid transport element 50 to provide the openings between the liquid store 30 and the vaporization chamber 40, an improved tight connection can be provided around the fluid transport element 50 to minimize leakage into the vaporization chamber. This can be improved further by the provision of annular seals 80 which are received in a seating provided by the opposing surfaces of the upper and lower housing portions 10, 20 which provide the opening 60 when connected. In this way, when the cartridge 100 is received in an aerosol generating device 200 as shown in FIG. 4 there is less leakage through the air inlets into the cartridge seating 202 which accordingly prolongs the life of the device and ensures it continues to operate effectively. Furthermore, the user experience is further improved as less aerosol generating liquid stored in the liquid store 30 travels into the vaporization chamber and less is carried as large droplets during inhalation by the user.

The invention claimed is:

1. A cartridge for an electronic cigarette comprising:

a liquid store arranged to contain a liquid to be vaporised;

a vaporisation chamber having at least one opening which connects the vaporisation chamber to the liquid store;

a fluid transfer element held within the at least one opening and arranged to transfer liquid between the liquid store and the vaporisation chamber by capillary action;

a heating element positioned within the vaporisation chamber and arranged to heat a liquid transferred to the vaporisation chamber by the fluid transfer element;

wherein the cartridge comprises an upper housing portion and a lower housing portion which provide an outer housing of the cartridge and are configured to connect together around the fluid transfer element to form the liquid store and the vaporisation chamber, and wherein the upper housing and the lower housing portion comprise one or more internal walls or divisions which, when connected together, define the liquid store, the vaporisation chamber and the at least one opening.

2. The cartridge according to claim 1, wherein the upper housing comprises a curved upper supporting surface and the lower housing portion comprises an opposing curved lower supporting surface; wherein the upper and lower supporting surfaces together form the at least one opening holding the fluid transfer element when the upper and lower housing portions are connected together.

3. The cartridge according to claim 1, wherein the at least one opening comprises two openings which connect the vaporisation chamber to the liquid store, and the fluid transfer element is elongate with two opposing ends; wherein the elongate fluid transfer element extends across the vaporisation chamber with each of the two opposing ends held in one of the two openings, respectively, and in fluid communication with the liquid store.

4. The cartridge according to claim 2, further comprising:

an annular seal mounted in each of the at least one openings which connect the vaporisation chamber to the liquid store; the annular seal engaged around the fluid transfer element such that liquid is restricted in passing through the respective opening of the at least one opening other than through the fluid transfer element.

5. The cartridge according to claim 4, wherein the curved upper supporting surface comprises an upper seal segment and the curved lower supporting surface comprises a lower seal segment; wherein the upper and lower seal segments together form the annular seal engaged around the fluid transfer element when the upper and lower housing portions are connected.

6. The cartridge according to claim 4, wherein the annular seal comprises an integral annular body and is sleeved on the fluid transfer element; wherein the upper and lower supporting surfaces provide a seating configured to receive the annular seal.

7. The cartridge according to claim 6, wherein the upper and lower supporting surfaces are shaped to form a circumferential groove when the upper and lower housing portions are connected, wherein the circumferential groove is configured to receive the annular seal.

8. The cartridge according to claim 7, wherein the circumferential groove comprises two circumferential surfaces forming a V-shaped cross-section and the annular seal comprises a rounded profile which meets both of the two circumferential surfaces to provide two circumferential contacts between the annular seal and the seating.

9. The cartridge according to claim 4, wherein the annular seal comprises a substantially cylindrical body with a rounded circumferential protrusion extending radially outward to meet the upper and lower supporting surfaces bounding the at least one opening.

10. The cartridge according to claim 4, wherein the annular seal comprises a substantially cylindrical body with an internal circumferential protrusion extending radially inward to press into the fluid transfer element within the annular seal.

11. The cartridge according to claim 4, wherein the annular seal comprises an elastic deformable material.

12. The cartridge according to claim 1, wherein contacting surfaces of the upper housing portion and the lower housing portion when connected define a plane which runs lengthwise through the fluid transfer element.

13. The cartridge according to claim 1, wherein the lower housing portion comprises air inlets to allow air into the vaporisation chamber; wherein the air inlets are provided on a raised portion of a lower internal surface of the vaporisation chamber.

14. The cartridge according to claim 13, further comprising a liquid absorbing material provided on the lower internal surface of the vaporisation chamber around the raised portion.

15. An electronic cigarette comprising the cartridge according to claim 1 and a power source arranged to provide power to the heating element.

16. A cartridge for an electronic cigarette comprising:

a liquid store arranged to contain a liquid to be vaporised;

a vaporisation chamber having at least one opening which connects the vaporisation chamber to the liquid store;

a fluid transfer element held within the at least one opening and arranged to transfer liquid between the liquid store and the vaporisation chamber by capillary action;

a heating element positioned within the vaporisation chamber and arranged to heat a liquid transferred to the vaporisation chamber by the fluid transfer element;

wherein the cartridge comprises an upper housing portion and a lower housing portion which provide an outer housing of the cartridge and are configured to connect together around the fluid transfer element to form the liquid store and the vaporisation chamber, and wherein the lower housing portion comprises air inlets to allow air into the vaporisation chamber; wherein the air inlets are provided on a raised portion of a lower internal surface of the vaporisation chamber.

17. The cartridge according to claim 16, further comprising a liquid absorbing material provided on the lower internal surface of the vaporisation chamber around the raised portion.

18. The cartridge according to claim 16, wherein the upper housing comprises a curved upper supporting surface and the lower housing portion comprises an opposing curved lower supporting surface; wherein the upper and lower supporting surfaces together form the at least one opening holding the fluid transfer element when the upper and lower housing portions are connected together.

19. The cartridge according to claim 16, wherein the at least one opening comprises two openings which connect the vaporisation chamber to the liquid store, and the fluid transfer element is elongate with two opposing ends; wherein the elongate fluid transfer element extends across the vaporisation chamber with each of the two opposing ends held in one of the two openings, respectively, and in fluid communication with the liquid store.

20. The cartridge according to claim 17, further comprising:

an annular seal mounted in each of the at least one openings which connect the vaporisation chamber to the liquid store; the annular seal engaged around the fluid transfer element such that liquid is restricted in passing through the respective opening of the at least one opening other than through the fluid transfer element.

* * * * *